US005662685A

United States Patent [19]

Uhler

[11] Patent Number: 5,662,685

[45] Date of Patent: Sep. 2, 1997

[54] SOUND PRODUCING PACIFIER

[76] Inventor: Gary S. Uhler, 10-B Alder Ct., Woodland, Calif. 95695

[21] Appl. No.: 696,259

[22] Filed: Aug. 13, 1996

[51] Int. Cl.[6] ..... A61J 17/00

[52] U.S. Cl. ..... 606/234

[58] Field of Search ..... 600/26, 234–236; 604/77; 215/11.1–11.6

[56] References Cited

U.S. PATENT DOCUMENTS

| | | | |
|---|---|---|---|
| 4,231,184 | 11/1980 | Corris et al. | 46/265 |
| 4,554,919 | 11/1985 | Hubert | 606/234 |
| 4,716,902 | 1/1988 | Swartz | 606/234 |
| 4,726,376 | 2/1988 | Dahan | 606/234 |
| 5,007,924 | 4/1991 | Jekel | 606/234 |
| 5,033,864 | 7/1991 | Lasecki et al. | 374/151 |
| 5,487,705 | 1/1996 | Clarke | 472/29 |
| 5,522,847 | 6/1996 | Kalis et al. | 606/234 |

*Primary Examiner*—Michael Buiz
*Assistant Examiner*—Nancy Connolly Mulcare
*Attorney, Agent, or Firm*—William S. Bernheim

[57] ABSTRACT

This invention relates to a pacifier which can play music and be activated to play such music remotely.

4 Claims, 1 Drawing Sheet

| | Description |
|---|---|
| 10 | Pacifier |
| 12 | Toot'S Finder |
| 14 | Responsive Nipple |
| 16 | Nipple Interior |
| 20 | Shield |
| 31 | Battery with Access Door |
| 32 | Speaker |
| 33 | Control Button |
| 34 | Receiver |
| 40 | Activation Button |
| 42 | Key Chain Loop |

SOUND PRODUCING PACIFIER

BACKGROUND OF THE INVENTION

1. Field of the Invention

This invention relates to infant pacifiers and more specifically, to a sound producing pacifier which produces sound to comfort an infant.

2. Description of the Prior Art

Numerous types of pacifiers have been made for infants. Pacifiers are known which generate sound based on various activities of the baby including compressing a self inflating ball or manipulation of a piece of material. Pacifiers are known which have electronic circuits to produce audible sound in response to manipulation of the nipple of the pacifier.

There are various drawbacks including unintended manipulation of the pacifier causing a sound which may awaken a newly sleeping baby. In addition pacifiers are frequently lost and hard to locate in low light or dark conditions.

OBJECTS OF THE INVENTION

Accordingly, it is an object of this invention to provide a pacifier having buttons for generating sound, having various choices of sounds and duration, responsive to remote activation for sound.

Another object is a pacifier which will not awake a baby inadvertently.

Yet another object is a pacifier which is responsive to suction in a more natural way.

Other objectives, advantages and novel features of the invention will become apparent to those skilled in the art upon examination of the invention and the accompanying drawings.

SUMMARY OF THE INVENTION

Brief Description of the Figures

The following detailed description, taken in conjunction with the accompanying drawings, illustrates a preferred embodiment of the invention. The drawings are.

DETAILED DESCRIPTION OF A PREFERRED EMBODIMENT

Figure 1:
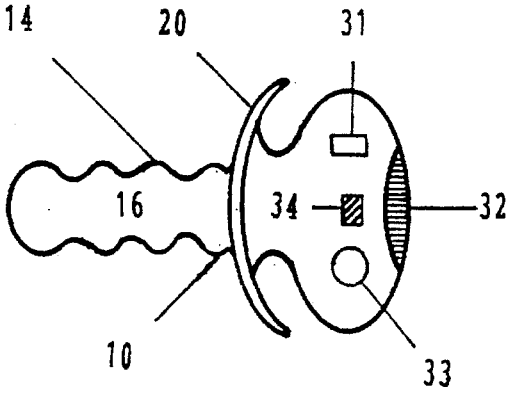
FIG. 1 is a side view of a pacifier in accordance With the invention.

Shown in FIG. 1 is a pacifier 10. The pacifier 10 includes a responsive nipple 14 which expands when subjected to a sucking action. A typical ribbed nipple 14 will be about ¾" in length and ⅜" in diameter; under a sucking action the length should increase to 1¼". The nipple's interior 16 is hollow and in air communication with the atmosphere. The nipple has a sucking end 18 and a distal end attached to a shield 20. The shield 20 serves several purposes including preventing a baby from ingesting the pacifier 10, limiting the entry of the nipple 14 into the baby's mouth, and imitating a breast. The shield 20 is preferably butterfly wing shaped to limit its orientation in a baby's mouth. The narrowness is to accommodate the baby's nose and avoid interference with the nose's function. The shield 20 is about 2½ inches in width and relatively thin with some give. The shield 20 should be convexed away from the nipple and the material on the nipple side should have the feel of a human breast.

The pacifier 10 further includes on the side of the shield 20 opposite an operations package 30. The operations package 30 includes an energy source such as a battery with access door 31, a music source powered by the battery with speaker 32, activation button 33 and an activation receiver 34 also powered by the battery. In an age of miniaturization, the operations package 30 could be made much smaller than is preferred. The preferred size of the package 30 is that it be large enough to prevent an infant or toddler from placing the package 30 in its mouth. The music source is designed to play not one, but preferably multiple lullabies in response to button 33 activation or receiver 34 activation and preferably, a periodic beep for locating purposes when activated through the receiver 34 for that purpose.

With the button 33 the playing of a lullaby can be initiated and then the pacifier 10 given to a baby.

Figure 2:
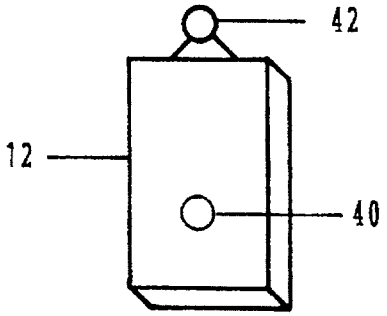
FIG. 2 is a side view of a controller in accordance with the invention.

Shown in FIG. 2 is a controller 12. The controller 12 includes a power source, transmitter and one or more activation buttons 40. The simplest model would have one button which when pushed sends a signal which if in proximity is received and processed by the receiver 34. One push of the button 40 results in a lullaby being played by the pacifier 10. Two quick pushes could activate a second lullaby or a periodic beep to assist finding a lost pacifier 10. A controller 12 with more buttons could activate a selection of lullabies and the beeper as desired by hitting different combinations of buttons. The controller 12 for convenience can include a key chain loop 42.

The beeping is a means for assisting in locating the pacifier 10. As an alternative means or additional means, the controller could include an illuminating surface which would shine when hit by a light source such as a flashlight.

I claim:

1. A baby pacifier having a responsive nipple, a shield attached to the nipple and between the nipple and an operations package which package includes an energy source, a music source powered by the energy source, an activation button connected to initiate the music source and an activation receiver which when activated by a remote source is connected to initiate the music source.

2. The pacifier of claim 1 wherein the shield is convex with respect to the nipple.

3. The pacifier of claim 1 wherein the operations package further includes an illuminating surface.

4. The pacifier of claim 1 separate controller which serves as the remote source to initiate music.

* * * * *